US007150304B2

(12) United States Patent
Hsu

(10) Patent No.: US 7,150,304 B2
(45) Date of Patent: Dec. 19, 2006

(54) CORDLESS BLIND STRUCTURE

(75) Inventor: Ben Hsu, Changhua Hsien (TW)

(73) Assignee: Ching Feng Blinds Ind. Co., Ltd., Changhua Hsien (TW)

( * ) Notice: Subject to any disclaimer, the term of this patent is extended or adjusted under 35 U.S.C. 154(b) by 127 days.

(21) Appl. No.: 10/721,291

(22) Filed: Nov. 26, 2003

(65) Prior Publication Data

US 2005/0109468 A1 May 26, 2005

(51) Int. Cl.
*E06B 3/48* (2006.01)

(52) U.S. Cl. ..... 160/84.01; 160/348

(58) Field of Classification Search ..... 160/84.01, 160/368.1, 349.2, 349.1, 330, 350, 348
See application file for complete search history.

(56) References Cited

U.S. PATENT DOCUMENTS 3,924,212 A * 12/1975 Brown ..... 335/303
4,397,346 A * 8/1983 Chumbley et al. ..... 160/84.01
4,802,523 A * 2/1989 Scholten et al. ..... 160/354
2004/0154754 A1* 8/2004 Judkins ..... 160/84.01

* cited by examiner

*Primary Examiner*—Blair M. Johnson
(74) *Attorney, Agent, or Firm*—Troxell Law Office, PLLC

(57) ABSTRACT

A cordless blind can include an upper beam, a body, and a plurality of magnet components. Generally, the body is attached to an underside of the upper beam. The body may include a top and foldable slats. One slat can be the bottommost slat. Generally, the plurality of magnet components are equidistantly distributed from the bottommost slat upward to the top of the body and alignable when the body is in a folded position. The cordless blind can have no pull cords or lift cords.

8 Claims, 6 Drawing Sheets

CORDLESS BLIND STRUCTURE

BACKGROUND OF THE INVENTION

The present invention is related to a cordless blind structure, comprising a blind body attached to the underside of an upper beam, and a plurality of magnet components equidistantly distributed from bottom to top of the blind body thereof wherein the magnet components are securely fixed to the outer surface of the blind body via thermal melting art or equidistantly sewed and concealed therein. To collect the blind body upward, the magnet components are consecutively piled up in line from bottom to top with each magnet component securely fastened to the immediate magnet components in juxtaposition thereby, precisely folding up and fixing the blind body at a desired position. And to unfold the blind body thereof, the blind body is pulled slightly downwards to detach the engaged magnet components from one another, releasing the collected blind body to suspend naturally downwards in display without any other pull cords or lift cords applied thereto.

A conventional blind structure is usually made up of a blind body 10 attached to the underside of an upper beam 11 wherein a volute wheel unit 12 is disposed at one side of the upper beam 11 thereof in cooperation with pull cords 13 and lift cords (without shown in the diagram) to fold up or unfold the blind body 10 thereof.

There are some drawbacks to such conventional blind structure. First, the volute wheel unit 12 disposed at one side of the upper beam 11 thereof must work with the pull cords 13 and lift cords in operation, which is quite complex in assembly. Second, when the blind body 10 is gathered up, pull cords 13 are suspended downwards for a certain length outside the blind thereof. Children playing around the blind may easily get caught by the suspending pull cords 13. In case the blind is carelessly unfolded, the withdrawing pull cords 13 might hurt or even strangle the children got caught in them. Thus, the conventional blind structure poses a potential danger to children in the household.

SUMMARY OF THE PRESENT INVENTION

It is, therefore, the primary purpose of the present invention to provide a cordless blind structure, comprising a blind body attached to the underside of an upper beam, and a plurality of magnet components equidistantly distributed from bottom to top of the blind body thereof wherein, via the magnet components, the blind body is easily and precisely folded up or unfolded without any other volute wheel unit, pull cords or T-shaped lift cords applied thereto, economically saving the cost of materials as well as the time of assembly.

It is, therefore, the second purpose of the present invention to provide a cordless blind structure wherein the blind body is easily and quickly folded up or unfolded via the magnet components without any pull cords applied thereto, preventing children from getting caught therein to protect the safety of the household.

It is, therefore, the third purpose of the present invention to provide a cordless blind structure wherein, to collect the blind body upward, the magnet components are consecutively piled up in line from bottom to top with each magnet component securely fastened to the immediate magnet components in juxtaposition thereby, precisely folding up and fixing the blind body at a desired position. And to unfold the blind body thereof, the blind body is pulled slightly downwards by the bottommost slat thereof to detach the engaged magnet components from one another for the blind body to suspend naturally downwards in display, facilitating the operation of the present invention in an easy and fast manner.

DETAILED DESCRIPTION OF THE PREFERRED EMBODIMENTS

Figure 1:
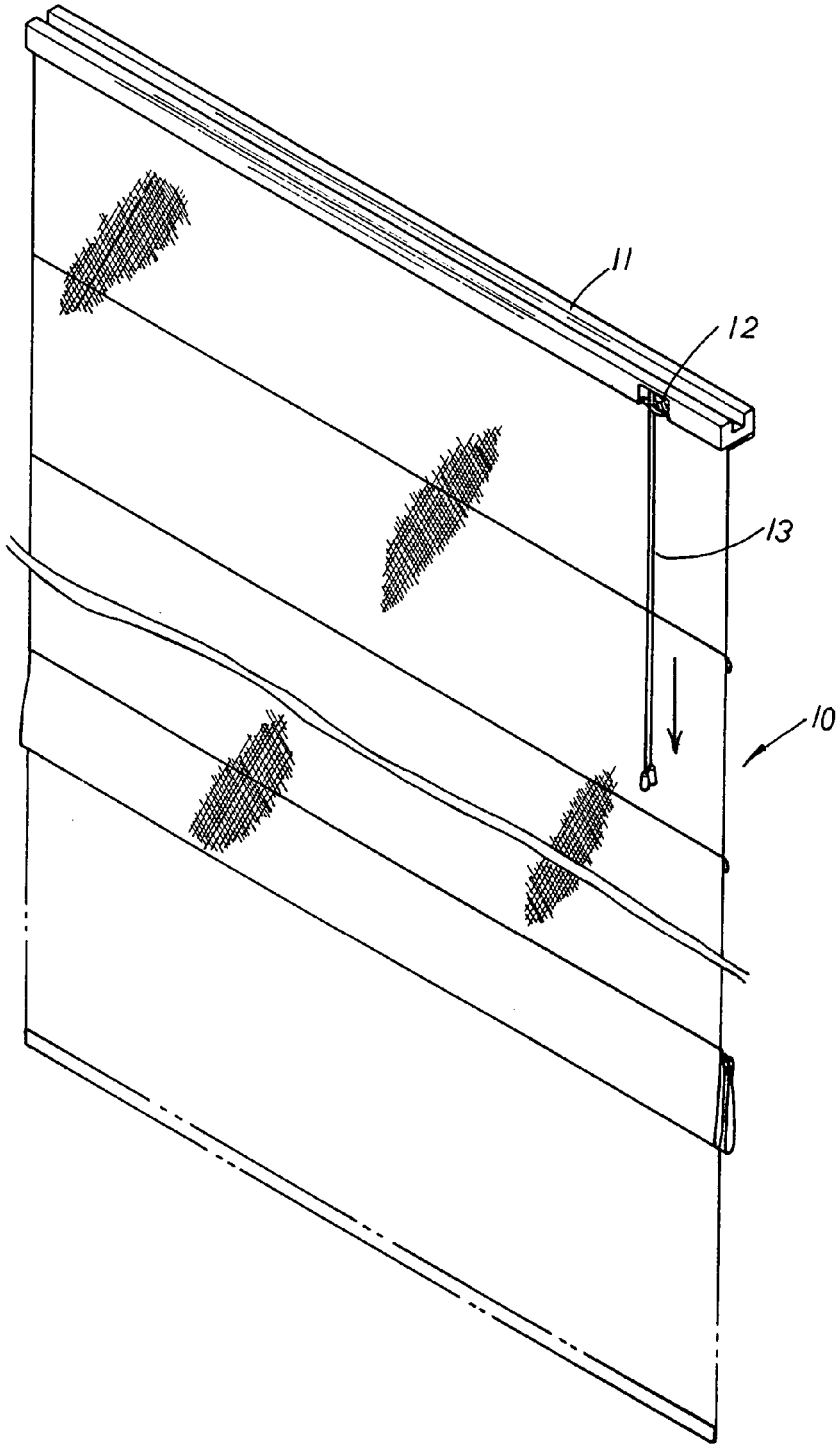
FIG. 1 PRIOR ART
FIG. 1 is a diagram showing a conventional blind structure in operation.
Figure 2:
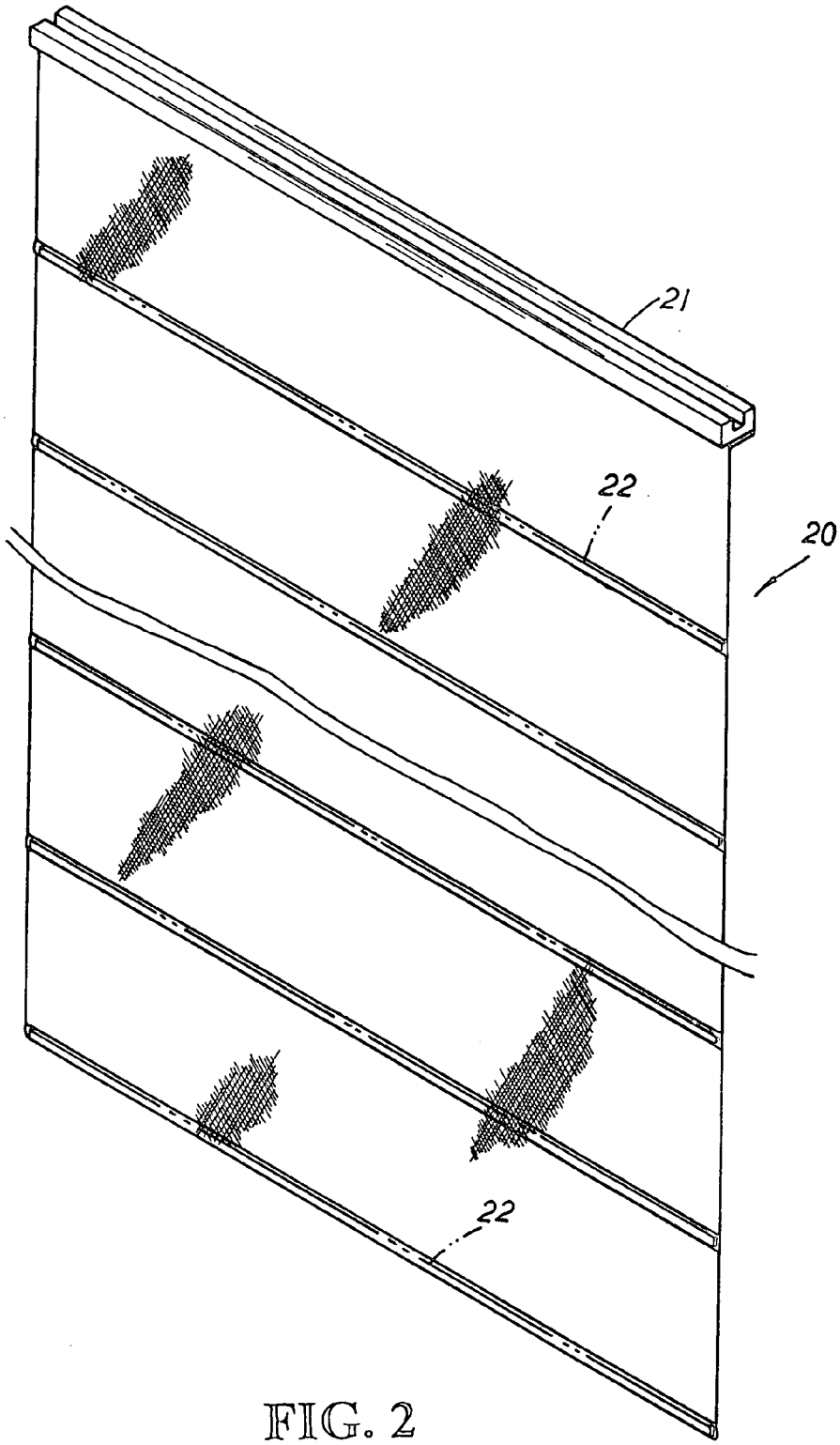
FIG. 2 is a perspective view of the present invention.
Figure 3:
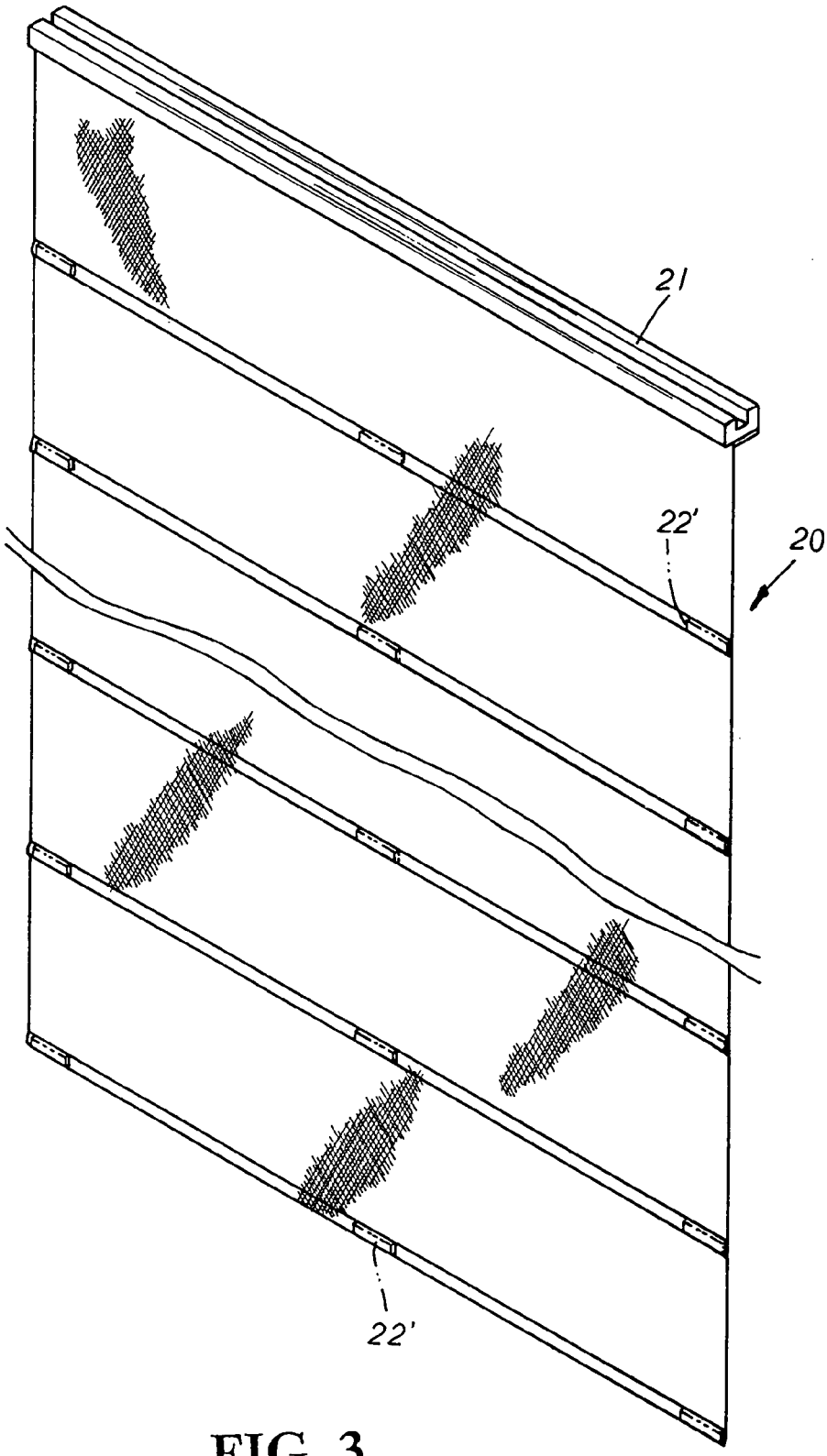
FIG. 3 is a diagram showing magnet components of elongated blocks and a blind body of the present invention in assembly.
Figure 4:
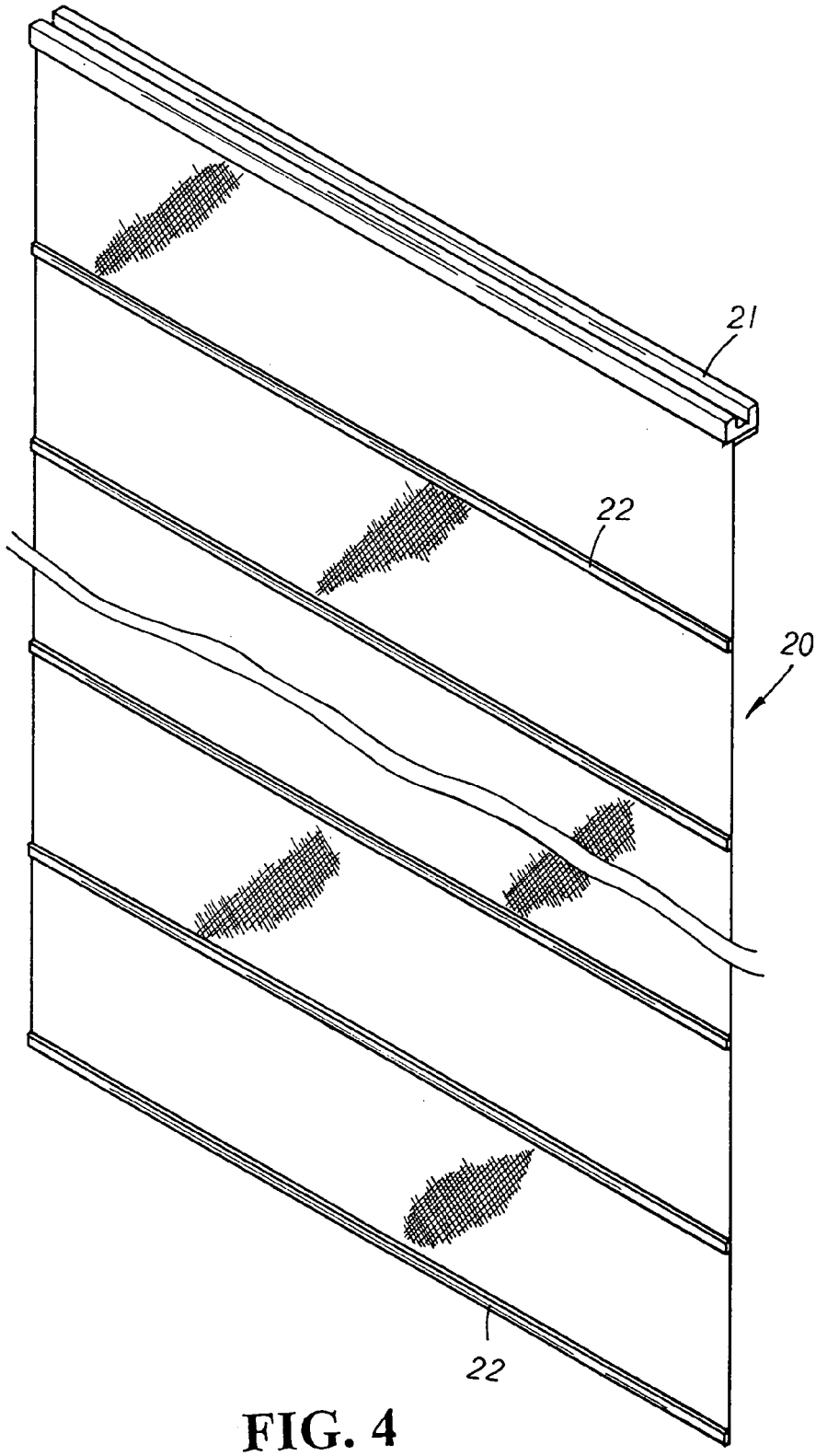
FIG. 4 is a diagram showing the magnet components fixed to the blind body of the present invention via thermal melting art.

Please refer to FIGS. 2 to 4 inclusive. The present invention is related to a cordless blind structure, comprising a blind body 20 attached to the underside of an upper beam 21. A plurality of magnet components 22 such as metal or rubber magnets are equidistantly distributed from the bottommost slat upward to the top of the blind body 20 thereof. The magnet components 22 can be of elongated bars as shown in FIG. 2, or magnet components 22' of elongated blocks 22' can also be transversely arranged in equal space at the blind body 20 thereon as shown in FIG. 3. The magnet components 22, 22' can be securely fixed onto the outer surface of the blind body 20 via thermal melting art as shown in FIG. 4 or sewed equidistantly inside the blind body 20 and concealed therein.

Figure 5:
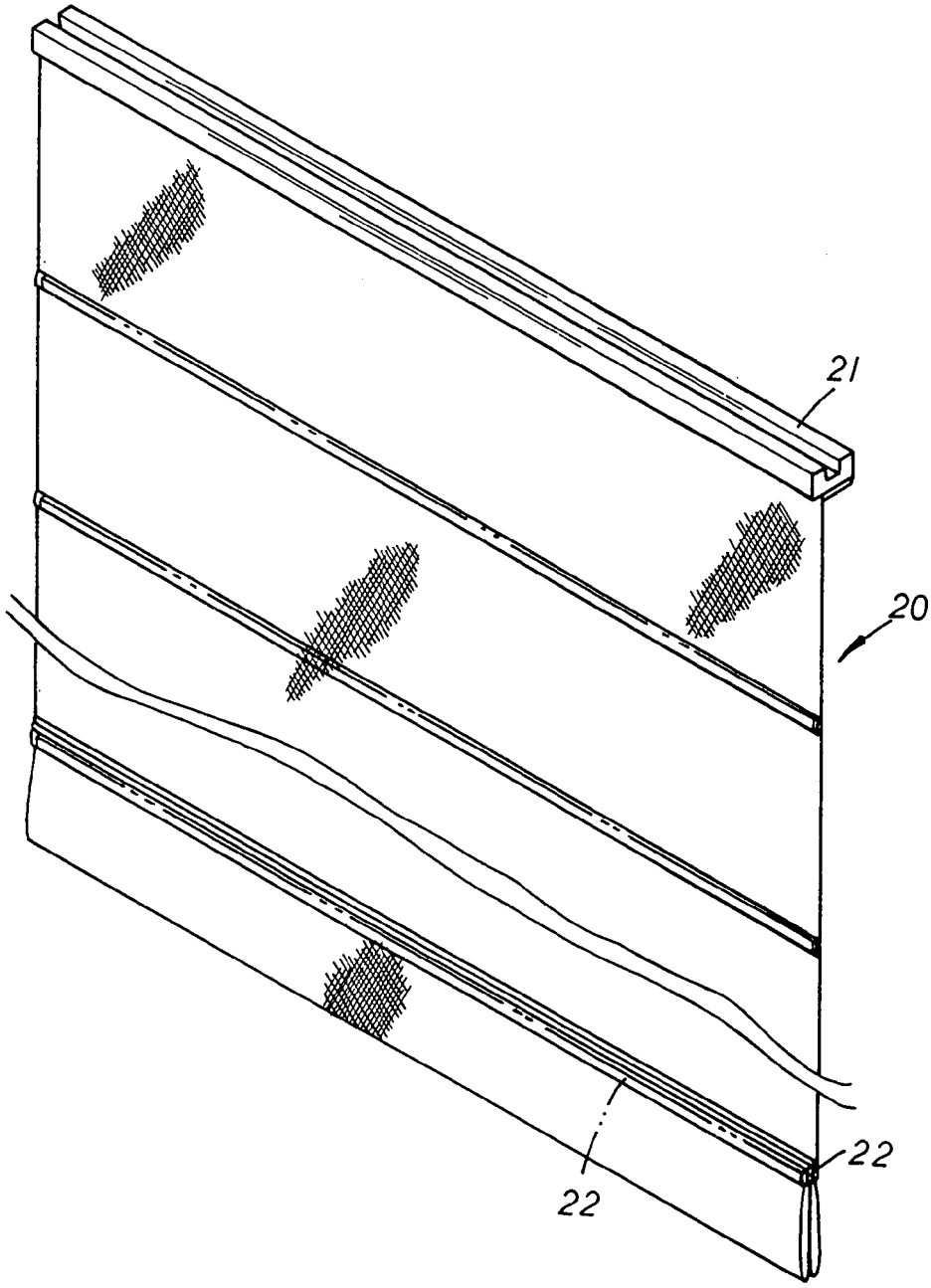
FIG. 5 is a diagram showing the blind body of the present invention in the folded-up status.
Figure 6:
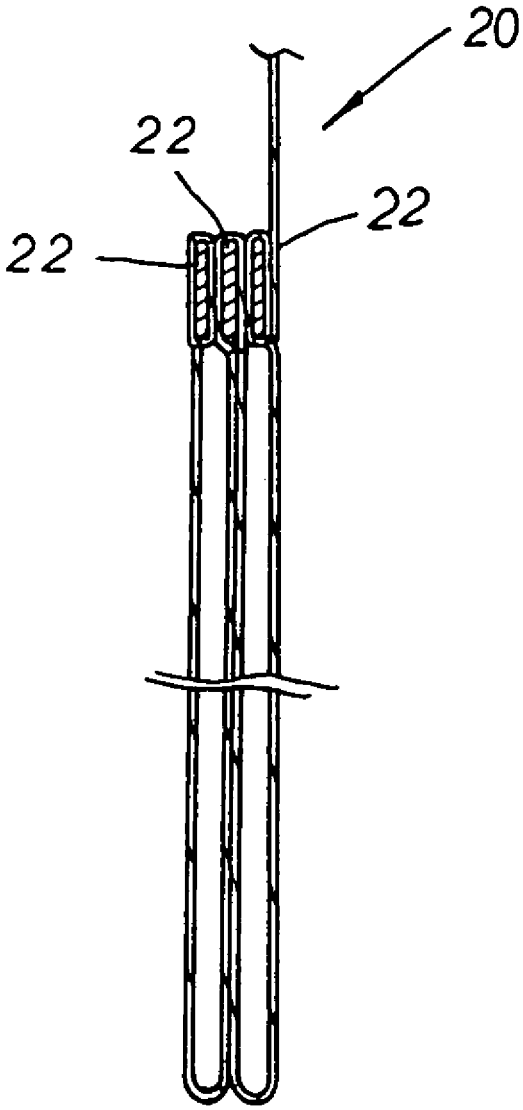
FIG. 6 is a cross sectional view of the present invention in the folded-up status.

Please refer to FIG. 5. To collect the blind body 20 upward, the magnet components 22 or 22' are consecutively lifted upwards from bottom to top to fold up the slats of the blind body 20 in half piece by piece till a proper position is reached. Meanwhile, the magnet components 22, 22' sequentially piled up in line are securely engaged with each magnet component 22, 22' fastened to the immediate magnet components 22, 22' in juxtaposition thereby as shown in FIG. 6. Via the magnet components 22, 22', the blind body 20 is easily folded up and precisely located at the desired position thereby. To unfold the blind body 20 thereof, the blind body 20 is pulled slightly downwards by the bottommost slat to detach the engaged magnet components 22, 22' from one another, releasing the collected the blind body 20 to suspend naturally downwards in display. Thus, the blind body 20 thereof can be precisely withdrawn or unfolded without any other pull cords or lift cords applied thereto, facilitating the operation of the blind body 20 thereof in an easy and fast manner.

What is claimed is:

1. A cordless blind, comprising:

a nonmagnetic upper beam;

a body attached to an underside of the upper beam, wherein the body has a top and comprises foldable slats wherein one slat is a bottommost slat; and a plurality of magnet components being equidistantly distributed from the bottommost slat upward to the top of the body and alignable when the body is in a folded position, the magnet components extending along and defining opposing horizontal edges of respective slats ;

with the proviso that the cordless blind has no cords for operating the blind.

2. The cordless blind according to claim 1, wherein the magnet components are elongated bars.

3. The cordless blind according to claim 1, wherein the magnet components are elongated blocks equally spaced and transversely arranged on the body.

4. The cordless blind according to claim 1, wherein the magnet components comprise metal magnets.

5. The cordless blind according to claim 1, wherein the magnet components comprise rubber magnets.

6. The cordless blind according to claim 1, wherein the plurality of magnet components secure the foldable slats in a folded, raised position.

7. The cordless blind according to claim 1, with the proviso that the cordless blind has no volute wheel.

8. The cordless blind according to claim 1, wherein the magnet components are fixed to the body by thermal melting.

* * * * *